US005228875A

United States Patent [19]

Swenson, Sr.

[11] Patent Number: 5,228,875

[45] Date of Patent: Jul. 20, 1993

[54] QUICK CONNECT ELECTRICAL CONNECTOR

[76] Inventor: Roger M. Swenson, Sr., Rte. #2, Box 49A, Williamsville, Mo. 63967

[21] Appl. No.: 758,833

[22] Filed: Sep. 12, 1991

[51] Int. Cl.[5] ..... H01R 4/38; H01R 4/28

[52] U.S. Cl. ..... 439/784; 439/805; 439/428; 174/845; 24/136 B

[58] Field of Search ..... 439/784, 805, 807, 863, 439/427, 428; 174/845; 24/136 R, 136 B, 136 L, 122.6

[56] References Cited

U.S. PATENT DOCUMENTS

| | | | |
|---|---|---|---|
| 1,039,542 | 9/1912 | Kennington | 439/805 |
| 1,649,923 | 11/1927 | Post | 439/807 |
| 2,724,097 | 11/1955 | Matthysse | 439/805 |
| 4,944,699 | 7/1990 | Velke, Sr. et al. | 439/784 |
| 5,018,251 | 5/1991 | Brown | 24/136 R |

FOREIGN PATENT DOCUMENTS

| | | | |
|---|---|---|---|
| 26368 | 6/1923 | France | 439/428 |
| 846809 | 9/1939 | France | 439/428 |
| 910390 | 6/1946 | France | 174/845 |
| 237857 | 9/1945 | Switzerland | 439/427 |
| 879864 | 10/1961 | United Kingdom | 439/427 |

*Primary Examiner*—Gary F. Paumen
*Attorney, Agent, or Firm*—Jim Zegeer

[57] ABSTRACT

A positive quick connect electrical connector for connecting the bare ends of a pair of electrical wires is constituted by a molded non-conductive female coupling member having a connection chamber therein and threaded walls. A metal connector member is secured to an end of one of the pair of electrical wires, the metal connector member being positioned in the connection chamber and having a conically-shaped end surface to provide a wire guiding and engaging surface for the bare end of the other of the pair of electrical wires. A non-conductive male coupling member has a bore therethrough. A first end of the bore has a conically-shaped annular wall which is complementary to the conically-shaped end surface on the metal connector member. The conically-shaped surfaces are spaced a variable distance S apart, and a threaded external surface on the male coupling member is in threaded engagement with the threaded internal bore in the female coupling member, whereby a bare end of the other of the pair of wires introduced into the bore of male coupling member is guided off axis by the conically-shaped end surface of the metal connector to a position between said spaced conical surfaces, and rotation of one of said members relative to the other engages threads to reduce the distance to clamp the bare end of said other of said pair of wires between the conical surfaces.

10 Claims, 2 Drawing Sheets

QUICK CONNECT ELECTRICAL CONNECTOR

BACKGROUND AND BRIEF DESCRIPTION OF THE INVENTION

There are many repair and replacement situations where electrical parts having electrical leads or harness extending therefrom to a supply or source of control signals. For example, there is need to replace the part which requires cutting one or more harness wires and then making a reconnection to the harness wire so that the part may be supplied with electrical control signals and operating potentials. For example, when a defective solenoid is being replaced, and long lead wires or harness to the source of control and operating potentials is routed through a tortuous path, frequently separate electrical connections to the solenoid coil do not exist. The coil wires simply extend out and form part of the solenoid harness going back to the source of potential.

An object of the present invention is to provide a quick and positive electrical connection in this and similar situations which is low in cost and easily performed in tight, cramped situations which sometimes exist where an OEM part having electrical leads is being replaced.

According to the invention, a quick connect electrical connector is provided for connecting the bare end of a pair of electrical wires is constituted by a non-conductive female coupling member having a connection chamber therein with threaded internal walls. A metal connector member is secured to one end of one of the electrical wires with the metal connector member being positioned in the connection chamber and having a conically shaped end surface to provide wire guiding and engaging surfaces for the bare end of the other of the electrical wires. A non-conductive male coupling member has a bore therethrough with a first end of the bore having a conically shaped annular wall which is complementary to the conically shaped end surface of the metal connector member so that in assembled relation, the conically shaped surfaces are spaced a variable distance apart. External threads on the coupling member are in threaded engagement with the threaded internal bore on the female coupling member whereby a bare end of the other of the pair of wires is introduced into the bore and the male coupling member is guided off axis by the conically shaped end surface on the metal connector member to a position between the space conical surfaces. Then, simple rotation of the members relative to each other causes the engaged threads to reduce the distance S between the conical surfaces and thereby clamp the end of the other pair of wires between the conical surfaces.

A stop is provided which allows bare wire to pass but blocks or stops the insulated portion of the wire from being jammed into the conical space between the conically-shaped surfaces.

An annular stop shoulder at one end of the connection chamber precludes separation of the female coupling member from the end of the wire having the metal connector member secured thereto. In the preferred embodiment, the metal connector member is secured to one end of the wire by crimping and, in the preferred embodiment, both male and female coupling members have knurlations formed on the external surfaces to facilitate gripping and twisting. It will be appreciated that portions of the surfaces can be hexogonally shaped so as to be gripped by a small wrenches and the like, if desired. However, in the preferred embodiment, it is all done by simple manual twisting of the male and female coupling elements with the bare wire end positioned between the conical surfaces.

DESCRIPTION OF THE DRAWINGS

The above and other objects, advantages and features of the invention will become more apparent when considered with the accompanying drawings wherein.

DETAILED DESCRIPTION OF THE INVENTION

Figure 1:
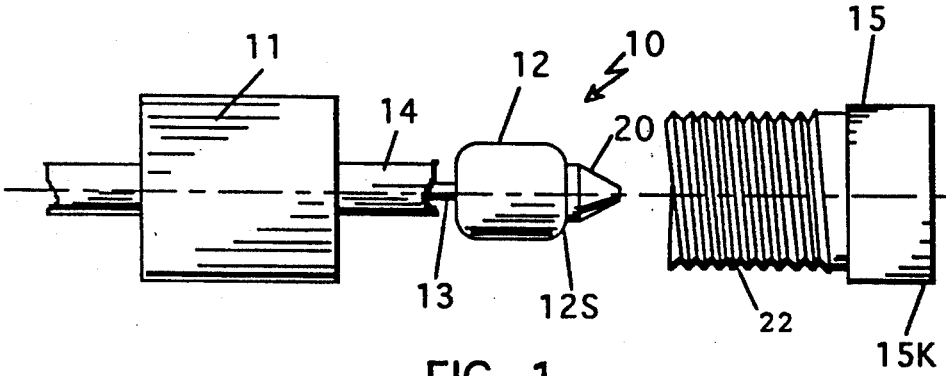
FIG. 1 is an exploded external view of the invention.
Figure 2:
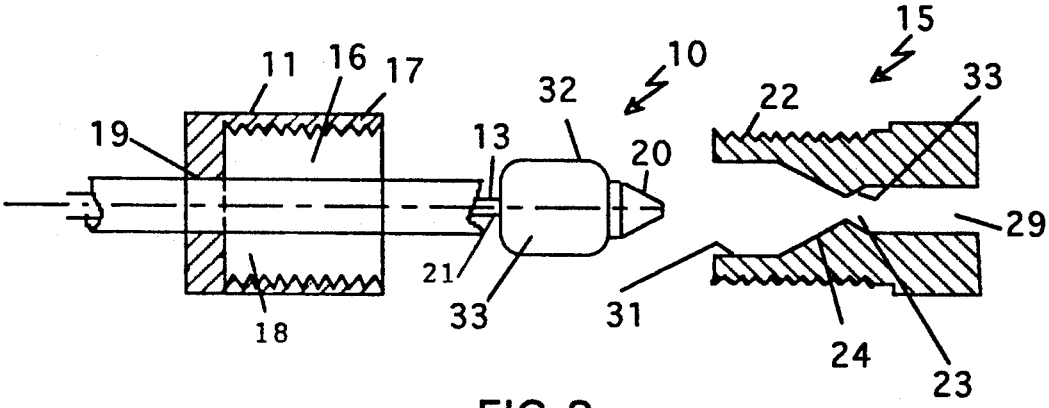
FIG. 2 is sectional views of the components shown in FIG. 1.
Figure 3:
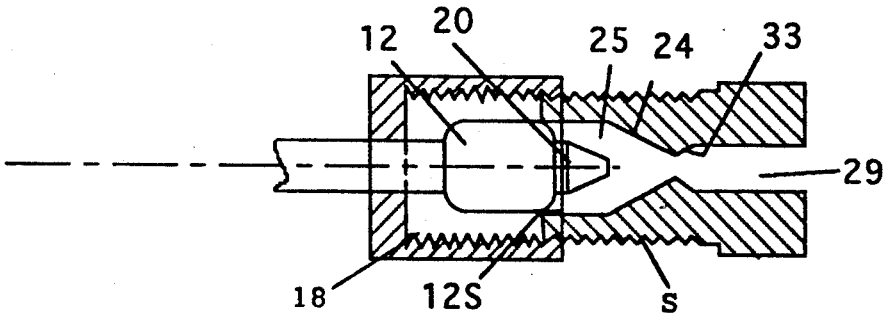
FIG. 3 illustrates the normal relationship of the male and female components.
Figure 4:
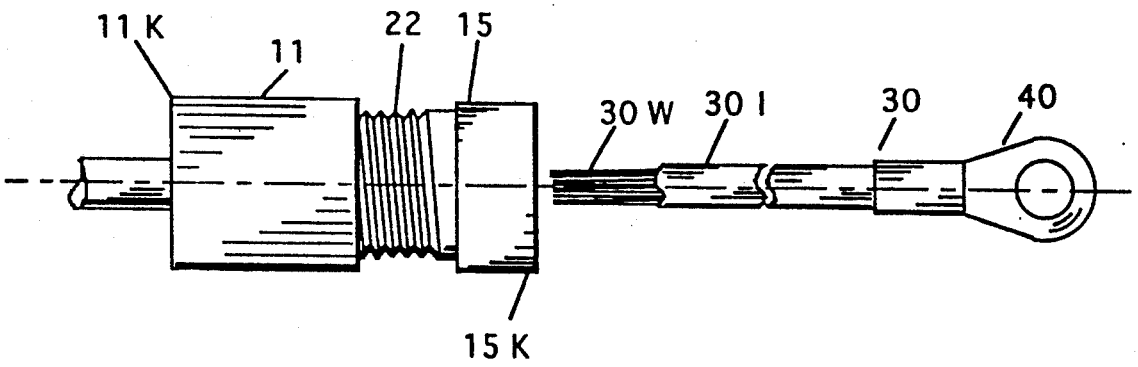
FIG. 4 shows a wire about to be inserted.
Figure 5:
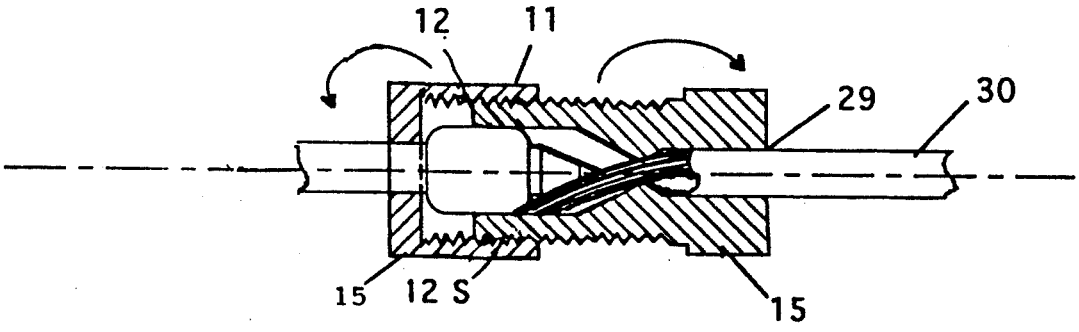
FIG. 5 illustrates the securement of the invention with the wire shown in FIG. 4 having been inserted into the blind bore with the non-conductive male and female coupling members so as to urge the conical surfaces towards one another so as to grab and tightly engage the bare end of the wire with the conical surfaces on the metal connector member.

Referring now to the drawings, the electrical connector 10 incorporating the invention includes a molded plastic female component 11, a metal connector member 12 which has been secured in this embodiment by crimping to wire 13 covered by insulation 14 and a non-conductive male coupling member 15 which is normally in threaded engagement with the female molded coupling member 11 in the manner illustrated in FIG. 4. Non-conductive female coupling member 11 has a connection chamber 16 therein which has threaded walls 17 and an annular stop shoulder 18 having a hole or aperture 19 which is just large enough to accommodate the outside diameter of the insulation 14 coated on wire 13. Metal connector member 12 crimped on the end of wire 13 has a bullet or conically shaped end surface 20 and a rear surface 21 which normally abuts shoulder 18. In the position shown in FIGS. 1 and 2, the insulation and wire 13, 14 have been pushed through the aperture 19 for purposes of exposition. The normal position of connector 18 is within connection chamber 16 as is shown in FIGS. 3, 4 and 5. Conically-shaped end surface 20 provides a wire engaging and guiding surface for the bare end of the wire to which the connector is to be connected so as to form an electrical connection between wire 13 and an electrical circuit (not shown). The non-conductive male and female coupling members can be machined, or molded from electrical insulation materials.

Non-conductive male coupling member 15 has a threaded external surface 22 which normally is threadably engaged at the left-most end with the threads 17 of the connection chamber in the molded non-conductive female coupling member as shown in FIG. 3. Male coupling member 15 has a through internal bore 23 and the left portion of the bore 23 has formed in the wall thereof a conically-shaped annular surface 24 which is complementary in shape to the conically-shaped end surface 20 of metal connector 12 so that when assembled in the position shown in FIG. 3, there is an annular conical space 25 between the conical surface 20 and the conical surface 24. The conically-shaped surfaces 20, 24 are spaced a variable distance S apart. The right-end portion 26 of bore 23 is cylindrical and of a diameter sufficient to accommodate or receive the outside insulation diameter of a wire 30 as illustrated in FIGS. 4 and 5. In addition, the left-most end 31 of bore 23 has a diameter sufficient to accommodate the right end 32 of crimping shank 33 of metal connector member 12.

An important feature of surface 33 is that it serves as a stop so the insulation 30I on the wire 30 cannot be jammed into the conical space 25 and prevent good electrical connection between the bare wire and surface 20.

In order to utilize the connector of this invention, the wire 30 is cut, preferably as close as possible, to the device being removed and the insulation 30I removed to expose the bare wire 30W for about ½ to ¾" and the braided wire 30W (it need not be braided wire) is twisted to form a tight strand of wire. It will be appreciated that it is not necessary to twist the wire but it is desirable that the strands be generally coherent or bunched without any frayed ends projecting outwardly so that they may be introduced as a unit into bore portion 29 of through bore 23. Any wires of the strand which are projecting outwardly are guided towards the center by conically-shaped sloping surface 33. Wire 30 is inserted in bore portion 29 until it bottoms-out. Shoulder 12S on metal connector 12 forms a stop. As the braided wires 30 engage the engaging and guiding surface 20, they are diverted or guided off axis by the conically-shaped surfaces 20 and 24 into space 25. The external surfaces of coupling member 11 and 15 are knurled as at 15K and 11K so that they may be easily gripped without slippage between the thumb and forefingers of the user and twisted in the direction indicated by the arrows in FIG. 5 in a direction to advance the molded non-conductive male coupling member into the non-conductive female coupling member 11 and thereby clamp the end of braided wire 30W in the manner shown in FIG. 5.

If there are plural connections to be made, the wires as well as the male and female members of the coupling members may be color-coded accordingly. The electrical connection is quite strong with surface contact between the bare braided wire 30 and the conical surface 20 being increased as the male coupling member 15 is twisted so as to compress and spread-out the the braided wire ends 30W in the space 25 between conical surfaces 20 and 24, respectively. Moreover, the positive gripping action can be easily and quickly released simply by untwisting the female and male coupling members 11 and 15, respectively. Moreover, since the braided wire 30 is merely inserted into the end bore 29 in male coupling member 15 and bottomed in the holes, and the twisting of male coupling member 5 relative to female coupling member 11 essentially is a blind operation requiring merely the insertion of the wire end 30W into the hole to where it bottoms-out and then twisting the coupling member 15.

The connector element 40 on the end of wire 30 is a part of the harness element for wiring 30.

While there has been shown and described a preferred embodiment of the invention, it will be appreciated that other embodiments, adaptations and changes can be incorporated in the invention without departing from the spirit and scope thereof.

What is claimed is:

1. A quick connect electrical connector for the bare ends of a pair of electrical wires comprising, a nonconductive female coupling member, said female coupling member having a connection chamber therein and a threaded internal wall, a metal connector member and means fixedly securing said metal connector member on an end of one of said pair of electrical wires, said metal connector member being positioned in said connection chamber and having a conically-shaped end surface tapering inwardly to a tip to provide a wire engaging and guiding surface for the end of the other of said pair of electrical wires, a nonconductive male coupling member, said nonconductive male coupling member having a bore therethrough along an axis thereof, said bore having first and second ends, said first end of said bore having a conically-shaped annular wall surface which is complementary to said conically-shaped end surface on said metal connector member, and a threaded external surface for threaded engagement with the threaded internal bore in said female coupling member, said conically-shaped surfaces being spaced a variable distance S apart, whereby, when a bore end of said other of said pair of wires is introduced into said bore in said male coupling member, it is guided off said axis by said conically-shaped end surface on said metal connector member to a position between said spaced conically-shaped surfaces, and rotation of one of said coupling members relative to the other of said coupling members reduces the distance S to clamp said end of said other of said pair of wires between said conically-shaped surfaces.

2. The quick connect electrical connector defined in claim 1 wherein said second end of said bore includes an insulation stop surface for preventing insulation on said other of said pair of wires from being jammed into the space between said conically-shaped surfaces.

3. The quick connect electrical connector defined in claim 1 wherein a second end of said bore includes a further conical surface for guiding loose wire strands centrally to the apex of said conical surfaces and serving as a stop to prevent insulation on said other of said pair of wires from being jammed into the space between said conically-shaped surfaces.

4. The quick connect electrical connector defined in claim 1 wherein said metal connector has a diameter D and said female coupling member has an annular stop shoulder of smaller diameter than the diameter D of said metal connector member.

5. A quick connect electrical connector for the bare ends of a pair of electrical wires comprising, a nonconductive female coupling member, said female coupling member having a connection chamber therein and a threaded internal wall, a metal connector member and means fixedly securing said metal connector member on an end of one of said pair of electrical wires, said metal connector member being positioned in said connection chamber and having a conically-shaped end surface tapering inwardly to a tip to provide a wire engaging and guiding surface for the end of the other of said pair of electrical wires, a nonconductive male coupling member, said nonconductive male coupling member having a bore therethrough along an axis thereof, said bore having first and second ends, said first end of said bore having a conically-shaped annular wall surface which is complementary to said conically-shaped end surface on said metal connector member, and a threaded external surface for threaded engagement with the threaded internal bore in said female coupling member, said conically-shaped surfaces being spaced a variable distance S apart, whereby, when a bare end of said other of said pair of wires is introduced into said bore in said male coupling member, it is guided off said axis by said conically-shaped end surface on said metal connector member to a position between said spaced conically-shaped surfaces, and rotation of one of said coupling members relative to the other of said coupling members reduces the distance S to clamp said end of said other of said pair of wires between said conically-shaped surfaces and wherein said metal connector having a shank portion and a bore in said shank portion with an end of said one of said pair of wires therein, and a crimp formed in said shank portion to secure said end of said one of said pair of wires thereto.

6. A quick blind connect electrical connector for the bare end of an electrical wire comprising:

a nonconductive first coupling member, said first coupling member having a connection chamber with a threaded wall and a central axis, a nonconductive second coupling member having a threaded wall, said nonconductive second coupling member having a through bore with first and second ends, a first end of said through bore having a first conically-shaped annular wall surface, a metal connector member, said metal connector member being positioned in said connection chamber and having a second conically-shaped end surface tapering inwardly to a tip, said conically-shaped surfaces being spaced a variable distance S apart when said threaded surfaces are engaged, said second end of said through bore including a further conical surface having an apex end for: (1) guiding loose wire strands to said apex end, and (2) preventing insulation on said other pair of wires from being jammed into the space between the first and second conically-shaped surfaces, whereby, when said first and second coupling members are partially threaded together and then a bare end of said electrical wire is introduced into said second end of said through bore in said second coupling member, said wire end is guided off said central axis by said conically-shaped end surface to a position between said spaced conically-shaped, and rotation of one of said coupling members relative to the other coupling members engages said threads to reduce the distance S and clamp said bare end of said electrical wire between said first and second conically-shaped surfaces.

7. A method of making blind quick connect electrical connection to a bare electrical wire comprising:

providing a molded nonconductive female coupling member with a connection chamber having an internally threaded wall and a central axis, and a nonconductive male coupling member having an externally threaded wall engaged with said internally threaded wall, the male coupling member having a bore therethrough and having a corresponding central axis, a first end of said bore having a first conically-shaped annular wall surface, a metal connector member, said metal connector member being positioned in said connection chamber and having a second conically-shaped surface form tapering inwardly to a tip to a wire guiding and engaging surface for the end of said electrical wire, said first and second conically-shaped surfaces being spaced a variable distance S apart, a second end of said bore having a third conical surface for guiding loose wire strands of the electrical wire to the central axis and preventing insulation on said electrical wire from being jammed into the space between the first and second conically-shaped surfaces, partially threading said first and second coupling members together and then inserting said wire end into said second end of said bore in said male coupling member and guiding said wire end off said central axis by said second conically-shaped surface to a position between said spaced first and second conically-shaped surfaces, and rotating one of said coupling members relative to the other engages threads to reduce the distance S and clamp said end of said wire between said first and second conically-shaped surfaces.

8. A device for making blind quick connect electrical connection to a bare electrical wire comprising:

a first nonconductive coupling member having a connection chamber having an internally threaded wall and a central axis, and a second nonconductive coupling member having an externally threaded wall and a bore therethrough and having a corresponding central axis, a first end of said bore having a first conically-shaped annular wall surface, a metal connector member, said metal connector member and being positioned in said connection chamber and having a second conically-shaped surface tapering inwardly to a tip to a wire guiding and engaging surface for guiding the end of said electrical wire off said central axis and between said first and second conically-shaped surfaces without first disassembling said first and second coupling members, said first and second conically-shaped surfaces being spaced a variable distance S apart, a second end of said bore having a third conical surface, for guiding loose wire stands of the electrical wire to the central axis and preventing insulation on said other pair of wires from being jammed into the space between the first and second conically-shaped surfaces, said externally threaded wall being threadably engaged with said internally threaded wall such that rotation of one of said coupling members relative to the other reduces said distance S and clamps said end of said wire between said conically-shaped surfaces.

9. The device defined in claim 8 wherein said first coupling member is a female coupling member and said second coupling member is a male coupling member.

10. The device defined in claim 8 wherein said metal connector member includes means for making an electrical connection to a second electrical wire.

* * * * *